US005544817A

United States Patent [19]

Brownbridge et al.

[11] Patent Number: 5,544,817

[45] Date of Patent: Aug. 13, 1996

[54] ZIRCONIUM SILICATE GRINDING METHOD AND MEDIUM

[75] Inventors: Thomas I. Brownbridge, Oklahoma City; Phillip M. Story, Yukon, both of Okla.

[73] Assignee: Kerr-McGee Chemical Corporation, Oklahoma City, Okla.

[21] Appl. No.: 359,219

[22] Filed: Dec. 19, 1994

Related U.S. Application Data

[63] Continuation-in-part of Ser. No. 186,085, Jan. 25, 1994, abandoned.

[51] Int. Cl.[6] ..... B02C 23/18

[52] U.S. Cl. ..... 241/21; 241/22; 241/24.1; 241/184

[58] Field of Search ..... 241/21, 22, 24, 241/184

[56] References Cited

U.S. PATENT DOCUMENTS 2,536,962 1/1951 Sorg ..... 201/75

FOREIGN PATENT DOCUMENTS 501143 9/1992 European Pat. Off. .
58-015079 1/1983 Japan .
WO9118843 12/1991 WIPO .

*Primary Examiner*—Timothy V. Eley
*Attorney, Agent, or Firm*—Herbert M. Hanegan; J. Rodgers Lunsford, Jr.

[57] ABSTRACT

A method for milling a powder in a high energy mill which includes steps of forming a milling slurry including a naturally occurring zirconium silicate sand grinding medium having a density in the range of from about 4 g/cc absolute to about 6 g/cc absolute. Also provided is a grinding medium including naturally occurring zirconium silicate sand characterized by a density in the range of from about 4 g/cc absolute to about 6 g/cc absolute.

27 Claims, No Drawings

ZIRCONIUM SILICATE GRINDING METHOD AND MEDIUM

CROSS REFERENCE TO RELATED APPLICATION

This application is a continuation in part of application Ser. No. 08/186,085, filed Jan. 25, 1994 which is now abandoned.

BACKGROUND OF THE INVENTION

1. Field of the Invention

The invention relates to grinding media and more particularly to zirconium silicate grinding media.

2. Description of the Prior Art

Many applications such as the production of ceramic parts, production of magnetic media and manufacture of paints require that the ceramic, magnetic or pigment powder, respectively, be as completely dispersed within the particular binder appropriate for a given application as possible. Highly dispersed ceramic powders result in ceramic parts of higher density and higher strength than those prepared from less completely dispersed solids. The data storage capabilities of magnetic media are limited by particle size and completely dispersed, finely divided powder magnetic media achieve maximum information storage. The optical properties of paints, such as hiding power, brightness, color and durability are strongly dependent on the degree of pigment dispersal achieved. Finely divided powders are required to achieve such complete powder dispersal. Typically, milling devices such as disc mills, cage mills, and/or attrition mills are used with a milling medium to produce such finely divided powders, ideally to reduce the powder to its ultimate state of division such as, for example, to the size of a single powder crystallite.

Milling of some powders involves a de-agglomeration process according to which chemical bonds, such as hydrogen-bonded surface moisture, Van der Waals and electrostatic forces, such as between particles, as well as any other bonds which are keeping the particles together, must be broken and/or overcome in order to obtain particles in their state of ultimate division. One pigment powder which entails a de-agglomeration milling process to reduce it to a finely divided powder is titanium dioxide. Optimal dispersal of titanium dioxide pigment powder results in optimized performance properties, particularly improved gloss, durability and hiding power.

De-agglomeration processes are best performed using a grinding medium characterized by a small particle size which is the smallest multiple of the actual size of the product particles being milled which can still be effectively separated from the product powder. In a continuous process, the grinding medium can be separated from the product particles using density separation techniques. In a typical bead or sand mill operated in a continuous process, separation of the grinding medium from the product can be effected on the basis of differences between settling rate, particle size or both parameters existing between the grinding medium and product powder particles.

Commercial milling applications typically use silica sand, glass beads, ceramic media or steel balls, for example, as grinding media. Among these, the low density of about 2.6 g/cc, of sand and glass beads and the low hardness of glass beads restricts the materials which can be milled using sand or glass beads. The use of steel shot is restricted only to those applications where iron contamination resulting from wear products of the steel shot during the milling process can be tolerated.

Thus, there exists a need for a relatively inexpensive, dense and non-toxic grinding medium which is characterized by a small particle size, a density sufficiently high for separation purposes to allow it to be used for the milling of a wide range of materials and which does not generate wear byproducts which result in contamination of the product powder.

SUMMARY OF THE INVENTION

The invention provides a relatively inexpensive, dense and non-toxic, naturally occurring zirconium silicate sand grinding medium which has small particle size and a sufficiently high density to make it suitable for grinding a wide range of materials, while not contaminating the product powder with its wear byproducts as well as a method for milling a powder using this grinding medium.

According to one aspect of the invention, a naturally occurring zirconium silicate sand characterized by a density in the range of from about 4 g/cc absolute to about 6 g/cc absolute, more preferably in the range of from about 4.6 g/cc absolute to about 4.9 g/cc absolute and most preferably in the range of from about 4.75 g/cc absolute to about 4.85 g/cc absolute is provided.

Another aspect of the invention provides a method for milling a powder comprising steps of providing a starting powder characterized by a starting powder particle size and a naturally occurring zirconium silicate sand grinding medium characterized by a grinding medium density in the range of from about 4.0 g/cc absolute to about 6.0 g/cc absolute and mixing the starting powder and the grinding medium with a liquid medium to form a milling slurry; milling the milling slurry for a time sufficient to produce a product slurry including a product powder having a desired product powder particle size and having substantially the same composition as the starting powder and separating the product slurry from the milling slurry.

An object of this invention is to provide a naturally occurring zirconium silicate sand grinding medium.

Another object of this invention is to provide a method for milling a powder using a naturally occurring zirconium silicate sand grinding medium.

Other and further objects, features and advantages of the present invention will be readily apparent to those skilled in the art upon reading the description of preferred embodiments which follows.

DESCRIPTION OF PREFERRED EMBODIMENTS

As used herein in the specification and in the claims which follow, the term "naturally occurring" indicates that the zirconium silicate sand is mined in the form of zirconium silicate sand of a particular particle size and is distinguished from zirconium silicate materials which are synthesized, manufactured or otherwise artificially produced by man. The zirconium silicate sand grinding medium of the invention occurs in nature in the appropriate size and shape which can be sorted to obtain the appropriate fraction for use in a particular grinding operation. The mined zirconium silicate sand is sorted to isolate the appropriate fraction of zirconium silicate sand, based on particle size considerations, to be used as a grinding medium. The term "grinding medium" as used herein in the specification and in the claims which follow refers to a material which is placed in a high energy milling device, such as a disc mill, cage mill or attrition mill, along with the powder to be ground more finely or de-agglomerated to transmit shearing action of the milling device to the powder being processed to break apart particles of the powder.

The invention provides a grinding medium including naturally occurring zirconium silicate sand characterized by a density in the range of from about 4 g/cc to about 6 g/cc, more preferably in the range of from about 4.6 g/cc to about 4.9 g/cc Sand most preferably in the range of from about 4.75 g/cc to about 4.85 g/cc.

The naturally occurring zirconium silicate sand tends to be single phase, while synthetic zirconium silicate ceramic beads are typically multiphase materials. Surface contaminants such as aluminum, iron, uranium, thorium and other heavy metals as well as $TiO_2$ can be present on the surfaces of the naturally occurring zirconium silicate sand particles. Once the surface contaminants are removed by any surface preconditioning process known to one skilled in the art, such as, for example, washing and classifying, chemical analyses indicate that any remaining contaminants are within the crystal structure of the zirconium silicate and do not adversely affect the powder being milled.

Since the density of the naturally occurring zirconium silicate sand as described above exceeds the 3.8 g/cc density typically characteristic of manufactured zirconium silicate beads, naturally occurring zirconium silicate sand grinding medium of a smaller particle size than that of manufactured zirconium silicate beads can be used, without the zirconium silicate sand floating out of the milling slurry, thus ceasing to be effective as a grinding medium.

The zirconium silicate sand grinding medium can be characterized by a particle size which is the smallest multiple of the particle size of the finished product particle size, the milled product powder particle size, which can be effectively separated from the milled product powder. Typically, the naturally occurring zirconium silicate sand particle size is greater than 100 microns and can be in the range of from about 100 microns to about 1500 microns, more preferably in the range of from about 100 microns to about 500 microns and most preferably in the range of from about 150 microns to about 250 microns. The mined, naturally occurring zirconium silicate sand can be screened using techniques well known to one skilled in the art to isolate a coarse fraction of sand having particles of an appropriate size to function as an effective grinding medium.

The grinding medium can be any liquid medium compatible with the product being milled and the milling process and can include water, oil, any other organic compound or a mixture thereof, and can be combined with the naturally occurring zirconium silicate sand to form a slurry. The liquid medium is selected depending upon the product being milled. The milled product powder may or may not be separated from the liquid medium after the milling process is complete; however, the grinding medium is usually separated from the liquid medium after the milling process is complete.

If the powder being milled is a pigment for use in an oil based paint or ink, the liquid medium can be an oil such as a naturally derived oil like tung oil, linseed oil, soybean oil or tall oil or mixtures thereof. These naturally occurring oils can be mixed with solvents such as mineral spirits, naphtha or toluol or mixtures thereof which can further include substances such as gums, resins, dispersants and/or drying agents. The liquid medium can also include other materials used in the manufacture of oil based paints and inks such as alkyd resins, epoxy resins, nitrocellulose, melamines, urethanes and silicones.

If the powder being milled is a pigment for use in a water based paint, such as a latex paint, the liquid medium can be water, optionally including antifoaming agents and/or dispersants. Also, if the powder is a ceramic or magnetic powder, the medium can be water and can also include dispersants.

The naturally occurring zirconium silicate sand and the liquid medium can be combined to form a grinding slurry which is further characterized by a grinding slurry viscosity which can be in the range of from about 1.0 cps to about 10,000 cps, more preferably in the range of from about 1.0 cps to about 500 cps and most preferably in the range of from about 1.0 cps to about 100 cps. In general, the grinding slurry viscosity is determined by the concentration of solids in the grinding slurry and, thus, the higher the concentration of solids in the grinding slurry, the higher will be the grinding slurry viscosity and density. There is no absolute upper limit to grinding slurry viscosity; however, at some viscosity, a point is reached where no grinding medium is needed, as is the case for plastics compounded in extruders, roll mills, etc. without a grinding medium.

The invention also provides a method for milling a powder including steps of providing a starting powder characterized by a starting powder particle size; providing a grinding medium including naturally occurring zirconium silicate sand characterized by a grinding medium density in the range of from about 4.0 g/cc absolute to about 6.0 g/cc absolute; providing a liquid medium; mixing the starting powder with the liquid medium to form a milling slurry; milling the milling slurry in a high energy disc or cage mill for a sufficient time to produce a product slurry including a product powder characterized by a desired product powder particle size and having substantially the same composition as the starting powder; and separating the product slurry including the product powder from the milling slurry.

The starting powder used in the method of the invention can be an agglomerated and/or aggregated powder. The agglomerated powder can be characterized by an agglomerated powder particle size less than about 500 microns and more preferably can be in the range of from about 0.01 micron to about 200 microns. For titanium dioxide pigment powders, the agglomerated powder has a particle size of in the range of from about 0.05 micron to about 100 microns which can be milled to approach the particle size of an individual titanium dioxide crystallite.

The starting powder can also be characterized by a starting powder density in the range of from about 0.8 g/cc absolute to about 5.0 g/cc absolute. The method of the invention is suitable for organic powders which typically have densities on the lower end of the above range as well as for inorganic powders such as titanium dioxide, calcium carbonate, bentonite or kaolin or mixtures thereof. The titanium dioxide starting powder can be an agglomerated titanium dioxide pigment which has a density in the range of from about 3.7 g/cc to about 4.2 g/cc.

The naturally occurring zirconium silicate sand used in the method of the invention can also be characterized by a zirconium silicate sand particle size greater than about 100 microns and can be in the range of from about 100 microns to about 1500 microns, more preferably in the range of from about 100 microns to about 100 microns and most preferably in the range of from about 150 microns to about 250 microns.

The liquid medium used in the method of the invention can be oil or water selected according to the criteria already described.

Step (5) of milling can be carried out in any suitable high energy milling device which employs a grinding medium, such as a cage mill or disc mill designed to support a vertical flow or horizontal flow.

The exact type of sand mill employed is a disc or cage mill with nominal shear rates of from about 6000 to about 14000 reciprocal minutes and with agitator peripheral speeds of from about 1000 to about 2500 feet per minute. Ball mills operate typically with shear rates of about 1000 reciprocal minutes and with peripheral speeds of about 150 feet per minute and would not produce acceptable results if used in this invention.

Media is retained in vertical disc mills and cage mills by gravitational settling. Stokes law predicts that much higher densities are required as particle size decreases. Since grinding efficiency increases as a function of the number of particles of grinding media, the use of smaller media are desirable. The density of the media therefore determines the optimum size which is practical in these mills.

It is the combination of the operational parameters of disc or cage mills and the high density of the zircon sand which allows one to take advantage of the specific size sand described with the resultant increase in the number of grinding centers per unit weight.

The present invention provides a milling time of from about 30 seconds to about 1 hour. Preferred milling times are from about 1 to about 4 minutes and the most preferred milling times are from about 2 to about 3 minutes. Prior art ball mills cannot provide sufficient milling action in such short milling times because such mills are low energy, tumbling mills, i.e., the material to be milled is provided with the milling material usually in a horizontal vessel and the vessel is then turned or tumbled. Ball mills typically have a milling time of about 24 hours when used to mill the powders described herein.

The milling process can be a batch or continuous process. Step (6) of separating the product slurry from the milling slurry can be accomplished by distinguishing the product slurry, which contains the product powder along with liquid medium from the milling slurry on the basis of a difference between starting powder and grinding medium physical properties and product powder particle physical properties such as particle size, particle density and particle settling rate. As already described, the product powder may or may not be separated from the liquid medium after the milling process is complete; however, the grinding medium is usually separated from the liquid medium after the milling process is complete. The product powder can be separated from the product slurry and subjected to further processing such as dispersing the powder in a dispersing medium to form a dispersion. Depending upon whether the dispersion is an oil based paint or ink or a water based paint or ink or a ceramic or magnetic powder dispersion, the dispersing medium can be selected according to the same criteria as already described for the selection of the liquid medium. If the product powder is to be used in the product slurry, no further dispersing steps are needed.

In order to further illustrate the present invention, the following examples are provided. The particular compounds, processes and conditions utilized in the examples are meant to be illustrative of the present invention and are not limited thereto.

EXAMPLE 1

The following example is provided to compare the performance as a grinding medium of conventional, commercially available synthetic zirconium silicate ceramic beads with the performance of standard 10–40 mesh (U.S.) silica sand.

Disc mills having a nominal shear rate of 14000 reciprocal minutes, agitator peripheral speed of 2500 feet per minute and nominal grinding chamber capacities of 275 gallons and overall capacities of 500 gallons were loaded separately with 3000 pounds of synthetic zirconium silicate ceramic beads of nominal 300 micron and 210 micron size and with 1200 pounds of standard 10–40 mesh (U.S.) silica sand, the highest mill loading feasible with silica sand. The mills loaded with 3000 pounds of synthetic zirconium silicate ceramic beads as well as the mill loaded with 1200 pounds of 10–40 mesh (U.S.) silica sand were operated at 16, 23 and 30 gallon per minute flow rates. The feed slurries fed through all mills had a density of 1.35 g/cc and contained titanium dioxide, approximately 40% of which was less than 0.5 micron in size in water. The size of the titanium dioxide particles in the product slurry was measured using a Leeds and Northrupp 9200 series Microtrac™ particle size analyzer in water with 0.2% sodium hexametaphosphate surfactant at ambient temperature. The results are summarized in Table 1 and indicate that the grinding efficiency of the synthetic zirconium silicate ceramic beads as indicated by the percentage of product powder less than or equal to 0.5 micron in size compares favorably with the grinding efficiency of 10–40 mesh (U.S.) silica sand.

TABLE 1

| Mill Product ≦ 0.5 micron | Flow Rate (gal/min) | Grinding Medium | % |
|---|---|---|---|
| A | 30 | 300 micron synthetic zirconium silicate ceramic beads | 66.57 |
| B | 30 | 300 micron synthetic zirconium silicate ceramic beads | 64.42 |
| A | 23 | 300 micron synthetic zirconium silicate ceramic beads | |
| B | 23 | 300 micron synthetic zirconium silicate ceramic beads | 70.41 |
| A | 16 | 300 micron synthetic zirconium silicate ceramic beads | 79.96 |
| B | 16 | 300 micron synthetic zirconium silicate ceramic beads | 71.26 |
| A | 30 | 210 micron synthetic zirconium silicate ceramic beads | 85.29 |
| B | 30 | 210 micron synthetic zirconium silicate ceramic beads | 74.72 |
| A | 23 | 210 micron synthetic zirconium silicate ceramic beads | 91.51 |
| B | 23 | 210 micron synthetic zirconium silicate ceramic beads | 83.11 |
| A | 16 | 210 micron synthetic zirconium silicate ceramic beads | 95.22 |
| B | 16 | 210 micron synthetic zirconium silicate ceramic beads | 95.22 |
| A | 30 | 10–40 mesh (U.S.) silica sand | 65.17 |

TABLE 1-continued

| Mill Product ≦ 0.5 micron | Flow Rate (gal/min) | Grinding Medium | % |
|---|---|---|---|
| B | 30 | 10–40 mesh (U.S.) silica sand | 54.28 |
| A | 23 | 10–40 mesh (U.S.) silica sand | 61.96 |
| B | 23 | 10–40 mesh (U.S.) silica sand | 57.76 |
| A | 16 | 10–40 mesh (U.S.) silica sand | 67.09 |
| B | 16 | 10–40 mesh (U.S.) silica sand | 59.48 |

Furthermore, when the properties of finished pigments processed with the 210 micron synthetic zirconium silicate ceramic beads were compared with those of pigments processed with silica sand, several improvements with respect to the properties of finished pigments processed with silica sand were observed. The improvements included an approximately 57% reduction in break time, which is defined as time to incorporate the pigment into an alkyd resin, an approximately 42% lowering in consistency, which is defined as the torque required to mix an alkyd resin paint system once the pigment is incorporated therein, an approximate 6 unit increase in B235 semi-gloss which is defined as a 60 degree gloss measurement in a latex paint system, a lowering by approximately 12 units of B202H haze, which is defined as the relative depth an image can be perceived on a paint surface and an increase of approximately 2 units in B202 gloss, which is defined as a measurement at 20 degrees of reflected light from a paint system made in an acrylic resin.

It is noted that the naturally occurring zirconium silicate sand grinding medium, because of its higher density and single phase microstructure, can produce a pigment powder having superior properties to those obtained using the synthetic zirconium silicate ceramic beads as described above.

EXAMPLE 2

Example 2 is provided to compare the performance of synthetic zirconium silicate ceramic beads with the performance of the naturally occurring zirconium silicate sand grinding medium of the invention. It is noted that the naturally occurring zirconium silicate sand has a higher density than the 3.8 g/cc density of synthetic zirconium silicate products which allows use of smaller naturally occurring zirconium silicate sand particles by comparison with the synthetic zirconium silicate product particle sizes, thereby providing greater grinding efficiency.

Plant trials using the naturally occurring zirconium silicate sand grinding medium having a particle size in the range of from about 180–210 microns in a cage mill having a nominal shear rate of 6000 reciprocal minutes and agitator peripheral speed of 1000 feet per minute showed that naturally occurring zirconium silicate sand can be used successfully at production flowrates to effect removal of coarse particles, having a particle size greater than 0.5 micron in a titanium dioxide pigment. No appreciable loss of media from the mill was observed.

Example 2 was conducted by changing flowrates in mill B, operating with conventional silica sand, and of mill C, operating with naturally occurring zirconium silicate sand. Sand loadings in mill B and mill C were similar to those used in Example 1, i.e., 1200 pounds of silica sand in mill B and 3000 pounds of naturally occurring zirconium silicate sand in mill C. Samples were obtained concurrently from both sand mills. Mill feed was also sampled to measure any particle size variability in feed particle size.

Particle size data, as provided in Table 2, shows that at either a low flowrate (approximately 13 gallons/minute) or at a high flowrate (approximately 35 gallons/minute) the naturally occurring zirconium silicate sand is much more efficient in reducing particle size, compared with the performance of the conventional silica sand. After a period of continuous operation, both mill overflows were sampled for pigment optical quality and contamination.

Contamination of the pigment product from the naturally occurring zirconium silicate sand grinding medium was minimal as measured by x-ray fluorescence examination of the pigment solids found in the mill overflow. Metal contaminant levels also measured by x-ray fluorescence were similar to those observed in pigments milled using a conventional silica sand grinding medium. The optical quality of the pigment milled with the naturally occurring zirconium silicate sand as measured by the B381 dry color and brightness test which is defined as the total light reflected from a powder compact surface and the spectrum of reflected light i.e. color, was comparable to that obtained for samples milled using conventional silica sand. Results of these tests are summarized in Table 3.

TABLE 2

Pigment Particle Size Data

| Parameter | Mill B | Mill C |
|---|---|---|
| Flowrate (g ~ min) | 13.2 | 13.2 |
| Median Particle meter | 0.37 | 0.24 |
| Fraction of Particles < 0.5 micron | 86.94 | 99.55 |
| Flowrate (gal/min) | 35.2 | 35.2 |
| Median Particle Diameter | 0.38 | 0.37 |
| Fraction of Particles < 0.5 micron | 75.64 | 87.55 |

TABLE 3

Pigment Chemical Composition and Optical Properties

| Property | Mill B | Mill C |
|---|---|---|
| % $Al_2O_3$ | 0.71 | 0.72 |
| % $ZrO_2$ | 0.01 | 0.01 |
| % Calgon | 0.06 | 0.06 |
| Fe ppm | 35 | 34 |
| Ni ppm | 10 | 8 |
| B381 Brightness | 97.87 | 97.94 |
| B381 Color | 1.14 | 1.09 |

After nineteen days of operation with the naturally occurring zirconium silicate sand, mill C was inspected for signs of wear on the rubber lining using a fiber optic probe inserted through a flange in the underside of the mill. Essentially no signs of wear on the rubber lining were observed as indicated by the condition of the weavelike pattern on the rubber mill lining which is normally present on the surface of freshly lined mills. By contrast, in a mill which had been operated for only one week using a conventional silica sand grinding medium, the mill lining showed considerable wear, especially to the leading edges of the mill rotor bars where the weavelike pattern had been almost completely worn away.

EXAMPLE 3

The following example is provided to show the differences in particle size, impurity content and grinding performance among naturally occurring zirconium silicate sands obtained from different natural sources.

Three naturally occurring zirconium silicate sand samples, hereinafter referred to as Sample 1, Sample 2 and Sample 3 were evaluated for particle size using a screen analysis conducted for thirty minutes on a Rotap™. Based on the data presented in Table 4, Sample 2 and Sample 3 are similar with respect to particle size, while Sample 1 is smaller, which can make it difficult to retain Sample 1 sand in a cage mill during a continuous process.

TABLE 4

Particle Sizes of Zirconium Silicate Sand Samples

| Sample Origin | Sample 1 | Sample 2 | Sample 3 |
|---|---|---|---|
| % 180 microns | 0.61 | 75.1 | 67.2 |
| % 150 microns | 5.73 | 16 | 32.1 |
| % less than 150 microns | 93.66 | 8.9 | 0.7 |

The three naturally occurring zirconium silicate sand samples were also subjected to elemental analysis using x-ray fluorescence techniques. The results of the elemental analysis are given in Table 5.

TABLE 5

Elemental Chemical Analysis of Zirconium Silicate Sands

| Sample Origin | Sample 1 | Sample 2 | Sample 3 |
|---|---|---|---|
| % Element | | | |
| % Na | 0.38 | 0.41 | 0.2 |
| % Al | 0.16 | 0.16 | 0.73 |
| % Si | 15.15 | 15.43 | 14.5 |
| % Cl | 0.2 | 0.24 | 0.1 |
| % Ti | 0.13 | 0.13 | 0.21 |
| % Y | 0.2 | 0.19 | 0.19 |
| % Zr | 48.16 | 47.69 | 48.88 |
| % Hf | 0.92 | 0.99 | 0.93 |
| % O | 34.49 | 35 | 34.07 |
| Trace Analysis | | | |
| P (ppm) | 659 | — | — |
| K (ppm) | — | — | 134 |
| Ca (ppm) | 327 | 614 | 689 |
| Cr (ppm) | — | 177 | — |
| Mn (ppm) | — | 201 | — |
| Fe (ppm) | 729 | 714 | 711 |

TABLE 5-continued

Elemental Chemical Analysis of Zirconium Silicate Sands

| Sample Origin | Sample 1 | Sample 2 | Sample 3 |
|---|---|---|---|
| Sr (ppm) | 81 | | |
| Pb (ppm) | 50 | | |
| Th (Ppm) | 90 | 200 | 180 |
| U (ppm) | 180 | 200 | 220 |

A laboratory scale grinding study was also performed with the three naturally occurring zirconium silicate sands. The study was conducted in a cage mill having a nominal shear rate of 10,000 reciprocal minutes and agitator peripheral speed of feet per minute under a standard laboratory sand load of 1.8:1 zirconium sand to pigment load. Table 6 shows the percent of particles passing 0.5 micron, i.e., particles having sizes smaller than 0.5 micron, after 2, 4 and 8 minutes of grinding, as well as the median particle diameter at these times. The pigment was an untreated interior enamel grade titanium dioxide pigment. Particle sizes were determined using a Microtrac™ particle size analyzer as has been described before.

TABLE 6

Pigment Grinding Performance

| Sample | Sample 1 Particle Size | | Sample 2 Particle Size | | Sample 3 Particle Size | |
|---|---|---|---|---|---|---|
| Origin Time | Median Diameter | % Passing 0.5 micron | Median Diameter | % Passing 0.5 micron | Median Diameter | % Passing 0.5 micron |
| Feed | | | | | | |
| (0 minutes) | 1 | 21.09 | 1 | 21.09 | 1 | 21.09 |
| 2 minutes | 0.45 | 61.93 | 0.48 | 53.45 | 0.48 | 53.66 |
| 4 minutes | 0.38 | 80.96 | 0.42 | 69.84 | 0.42 | 71.53 |
| 8 minutes | 0.33 | 94.02 | 0.35 | 87.97 | 0.36 | 88.66 |

What is claimed is:

1. A method for milling a powder comprising the steps of:

(1) providing a starting powder characterized by a starting powder particle size;

(2) providing a grinding medium comprising naturally occurring zirconium silicate sand characterized by a grinding medium density in the range of from about 4.0 g/cc absolute and a particle size in the range of from about 100 microns to about 500 microns to about 6.0 g/cc absolute;

(3) providing a liquid medium;

(4) mixing said starting powder, said grinding medium and said liquid medium to form a milling slurry;

(5) milling said milling slurry in a high energy mill for a time sufficient to produce a product slurry including a product powder characterized by a desired product powder particle size and having substantially the same composition as said starting powder; and (6) separating said product slurry including said product powder from said milling slurry so that said grinding medium remains in said milling slurry.

2. The method of claim 1 wherein the high energy mill has a nominal shear rate of from about 6000 to about 14000 reciprocal minutes and an agitator peripheral speed of from about 1000 to about 2500 feet per minute.

3. The method of claim 2 wherein the high energy mill is selected from the group consisting of disc mills and cage mills.

4. The method of claim 2 wherein said milling device has a vertical flow design.

5. The method of claim 2 wherein said milling device has a horizontal flow design.

6. The method of claim 1 wherein said starting powder is an agglomerated powder.

7. The method of claim 6 wherein said agglomerated powder is further characterized by an agglomerated powder particle size and said agglomerated powder particle size is in the range of from about 0.01 micron to about 500 microns.

8. The method of claim 7 wherein the agglomerated powder has a particle size in the range of from about 0.01 micron to about 200 microns.

9. The method of claim 1 wherein said starting powder and said product powder are further characterized by a powder density in the range of from about 0.8 g/cc absolute to about 5 g/cc absolute.

10. The method of claim 1 wherein said starting powder is an organic powder.

11. The method of claim 1 wherein said starting powder is an inorganic powder.

12. The method of claim 1 wherein said starting powder is an agglomerated titanium dioxide pigment.

13. The method of claim 1 wherein said starting powder is an aggregated powder.

14. The method of claim 1 wherein the zirconium silicate sand particle size is in the range of from about 150 microns to about 250 microns.

15. The method of claim 1 wherein said step (6) of separating said product slurry from said milling slurry is accomplished by distinguishing said product slurry from said milling slurry on the basis of a difference between starting powder, grinding medium and product powder physical properties wherein the physical properties are selected from the group consisting of particle size, particle density and particle settling rate.

16. The method of claim 1 wherein said steps are performed continuously.

17. The method of claim 1 wherein said steps are performed according to a batch process.

18. The method of claim 1 further comprising steps of separating said product powder from said product slurry and dispersing said product powder in a dispersing medium to form a dispersion.

19. The method of claim 1 wherein said zirconium silicate sand particle size is the smallest particle size which can be separated from the milled product powder.

20. The method of claim 1 wherein said liquid medium is selected from the group consisting of water, oil, organic compounds and mixtures thereof.

21. The method of claim 1 wherein said naturally occurring zirconium silicate sand and said liquid medium form a grinding slurry.

22. The method of claim 21 wherein said grinding slurry is further characterized by a viscosity in the range of from about 1.0 cps to about 10,000 cps.

23. The method of claim 22 wherein said grinding slurry is further characterized by a viscosity in the range of from about 1.0 cps to about 500 cps.

24. The method of claim 23 wherein said grinding slurry is further characterized by a viscosity in the range of from about 1.0 cps to about 100 cps.

25. The method of claim 1 wherein the grinding medium has a density in the range of from about 4.6 g/cc absolute to about 4.9 g/cc absolute.

26. The method of claim 25 wherein the grinding medium has a density in the range of from about 4.75 g/cc absolute to about 4.85 g/cc absolute.

27. The method of claim 1 wherein said zirconium silicate sand particle size is in the range of from about 150 microns to about 250 microns.

* * * * *

UNITED STATES PATENT AND TRADEMARK OFFICE

CERTIFICATE OF CORRECTION

PATENT NO. : 5,544,817

DATED : August 13, 1996

INVENTOR(S) : Phillip M. Story and Thomas I. Brownbridge

It is certified that error appears in the above-indentified patent and that said Letters Patent is hereby corrected as shown below:

Column 10, line 16, delete "speed of feet" and insert --speed of 1750 feet--

Signed and Sealed this

Fourteenth Day of October, 1997

*Attest:*

*Attesting Officer*

Bruce Lehman

BRUCE LEHMAN

*Commissioner of Patents and Trademarks*